US008528476B2

(12) United States Patent
Raasch et al.

(10) Patent No.: US 8,528,476 B2
(45) Date of Patent: Sep. 10, 2013

(54) WASHING DEVICE FOR A CYLINDER IN A PRINTING PRESS

(75) Inventors: Gerd Raasch, Sandhausen (DE); Ralf Denger, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1272 days.

(21) Appl. No.: 12/166,616

(22) Filed: Jul. 2, 2008

(65) Prior Publication Data

US 2009/0007810 A1 Jan. 8, 2009

(30) Foreign Application Priority Data

Jul. 2, 2007 (DE) ..... 10 2007 030 572

(51) Int. Cl.
*B41F 35/00* (2006.01)

(52) U.S. Cl.
USPC ..... 101/424; 101/425

(58) Field of Classification Search
USPC ..... 101/424
See application file for complete search history.

(56) References Cited

U.S. PATENT DOCUMENTS

| | | | | |
|---|---|---|---|---|
| 2,855,526 | A | 10/1955 | Jones | |
| 3,173,034 | A * | 3/1965 | Dickey et al. | 310/322 |
| 4,001,766 | A | 1/1977 | Hurwitz | |
| 5,117,752 | A | 6/1992 | Micheli | |
| 5,523,058 | A | 6/1996 | Umemura et al. | |
| 5,803,099 | A | 9/1998 | Sakuta et al. | |
| 6,347,587 | B2 * | 2/2002 | Ghisalberti et al. | 101/424 |
| 6,386,106 | B1 * | 5/2002 | Stanka | 101/425 |
| 6,395,096 | B1 | 5/2002 | Madanshetty | |
| 6,432,211 | B1 * | 8/2002 | Schmitt et al. | 134/6 |
| 6,634,290 | B1 * | 10/2003 | Shimizu et al. | 101/129 |
| 6,865,986 | B2 | 3/2005 | Link | |
| 2002/0096578 | A1 | 7/2002 | Al-Jiboory | |
| 2002/0152908 | A1 * | 10/2002 | Corti et al. | 101/423 |

FOREIGN PATENT DOCUMENTS

| | | | |
|---|---|---|---|
| DE | 42 13 636 | A1 | 10/1992 |
| DE | 197 32 060 | A1 | 1/1999 |
| DE | 100 63 987 | A1 | 7/2002 |
| DE | 10135658 | A1 | 2/2003 |
| DE | 10148401 | A1 | 4/2003 |
| JP | 5-269450 | A | 10/1993 |
| JP | 11-70641 | A | 3/1999 |
| JP | 200611048 | * | 4/2006 |
| WO | 03/011599 | A1 | 2/2003 |
| WO | 03/099474 | A1 | 12/2003 |
| WO | 2004005029 | A1 | 1/2004 |
| WO | 2006/040993 | A1 | 4/2006 |

OTHER PUBLICATIONS

German Patent and Trademark Office Search Report, dated Jan. 21, 2008.
European Search Report dated Jan. 4, 2011.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A washing device for a cylinder in a printing press includes a washing cloth for removing contaminants and ink, etc. from the surface of the cylinder and an ultrasonic source directing sound energy onto the surface of the cylinder to assist a washing operation. A focusing device disposed in front of the ultrasonic source concentrates the sound energy on a substantially linear focus region on the surface of the cylinder, extending parallel to the axis of the cylinder.

30 Claims, 8 Drawing Sheets

WASHING DEVICE FOR A CYLINDER IN A PRINTING PRESS

CROSS-REFERENCE TO RELATED APPLICATION

This application claims the priority, under 35 U.S.C. §119, of German Patent Application DE 10 2007 030 572.0, filed Jul. 2, 2007; the prior application is herewith incorporated by reference in its entirety.

BACKGROUND OF THE INVENTION

Field of the Invention

The invention relates to a washing device for a cylinder in a printing press, having a washing cloth and an ultrasonic source which directs sound energy onto the cylinder surface.

A washing device of that type is known, for example, from International Publication No. WO 03/011599. There, in order to assist the washing operation, an ultrasonic source is provided which is intended to be used for the easier removal of contaminants and ink, etc. from the surface of the blanket stretched on a transfer cylinder in an offset printing press. Furthermore, German Published, Non-Prosecuted Patent Application DE 100 63 987 A1, corresponding to U.S. Pat. No. 6,865,986, describes a cloth washing device for a digital printing press. There, in order to clean the cylinder carrying the printing image, a cleaning band impregnated with a liquid can be acted upon on the cylinder surface by an ultrasonic actuator. Furthermore, German Published, Non-Prosecuted Patent Application DE 197 32 060 A1 describes a washing device for the blanket cylinder of an offset printing press which has an ultrasonic generator but no washing cloth. In that case, the intention is for the loosened dirt particles to be doctored off the cylinder surface by rubber lips.

In Patent Abstracts of Japan Publication No. JP 01170641, a use is described of a washing doctor vibrating in the ultrasonic range, which is in direct mechanical contact with the rubber surface. In apparatuses of that type, there is the risk that the cleaning liquid sprayed onto the blanket in front of the doctor will get into the printing press and cause damage there as a result of corrosion, etc.

The so-called cloth washing devices normally used heretofore in offset printing presses with which, during a job change, the inked blanket on the transfer cylinder is cleaned, normally have no ultrasonic sources to assist washing. Even without such assistance, the washing time is about 2 minutes, with the blanket being washed clean within 3 to 4 cylinder revolutions. Nevertheless, there is the desire to shorten the washing times with the effect of a rapid job change. However, that was not possible with the ultrasonic-assisted washing devices described in the prior art, the implementation of which failed due to the fact that the devices proposed required too much power. That is because, in order to achieve the ultrasonic cleaning action when sweeping over the blanket surface once, very high ultrasonic power densities are required on the inked blanket surface, as are otherwise known only from material processing and can be achieved, for example, with welding sonotrodes. Conventional inexpensive sound generators are not capable of making that requisite ultrasonic power available. Due to the low efficiency of the conversion from electric power into sound power, they themselves heat up very highly, which can lead to the destruction of the sound sources. Therefore, the previous proposals for improving the washing performance of blanket washing devices with the assistance of ultrasound have not been able to make progress.

It is known from ultrasonic diagnostics to focus the ultrasonic waves to produce ultrasonic images. However, configurations of that type are unsuitable for washing devices.

U.S. Pat. No. 5,803,099 discloses a washing tank having ultrasonic generators, with sound fields which are focused onto point-like regions by spherical ultrasonic lenses. That washing device is not suitable for the rapid cleaning of cylinder surfaces.

SUMMARY OF THE INVENTION

It is accordingly an object of the invention to provide a washing device for a cylinder in a printing press, which overcomes the hereinafore-mentioned disadvantages of the heretofore-known devices of this general type, which shortens a washing operation considerably and which manages with an acceptable connected electric power.

With the foregoing and other objects in view there is provided, in accordance with the invention, a washing device for a cylinder in a printing press. The washing device comprises a washing cloth for removing at least contaminants and ink from a surface of the cylinder, an ultrasonic source directing sound energy onto the surface of the cylinder for assisting a washing operation, and a focusing device disposed in front of the ultrasonic source for concentrating the sound energy onto a substantially linear focus region on the surface of the cylinder extending parallel to an axis of the cylinder.

According to the invention, the sound energy emitted by one or more ultrasonic generators belonging to an ultrasonic source is concentrated onto a substantially linear focus region on the cylinder surface, extending parallel to the cylinder axis. To this end, use is advantageously made of a cylindrical ultrasonic lens, which includes a single or a plurality of cylindrical or toroidal sound lenses. In addition, the focusing device can also be formed through the use of a cylindrical concave shape of sonotrodes or ultrasonic oscillators. It is possible, of course, for the two measures, the cylindrical sound lens and the concave shape of the sonotrodes, to be combined with each other. The high sound energy density produced on the cylinder or blanket surface in the substantially linear focus region then loosens the ink or contaminants from the surface, with the dirt or ink particles being transported away by the wet washing cloth resting on the surface. In this case, it can be particularly advantageous if the washing cloth is moved away continuously over the linear focus region during the washing operation, while at the same time the cylinder rotates at a high surface speed counter to or in the direction of the washing cloth movement.

Furthermore, it is expedient to use the cylindrical sound lens, which produces the linear focus either on its own or together with other aids, to press the washing cloth against the cylinder surface to be cleaned. The construction becomes particularly simple when this cylindrical lens is formed as a tubular plastic part, in the interior of which the washing liquid for wetting the washing cloth or the cooling liquid for cooling the ultrasonic generator is contained. In this case, two or more functions, namely carrying the washing liquid or cooling liquid, focusing the ultrasonic energy and pressing the washing cloth onto the rubber or cylinder surface, are fulfilled by one component.

Other features which are considered as characteristic for the invention are set forth in the appended claims.

Although the invention is illustrated and described herein as embodied in a washing device for a cylinder in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 9:
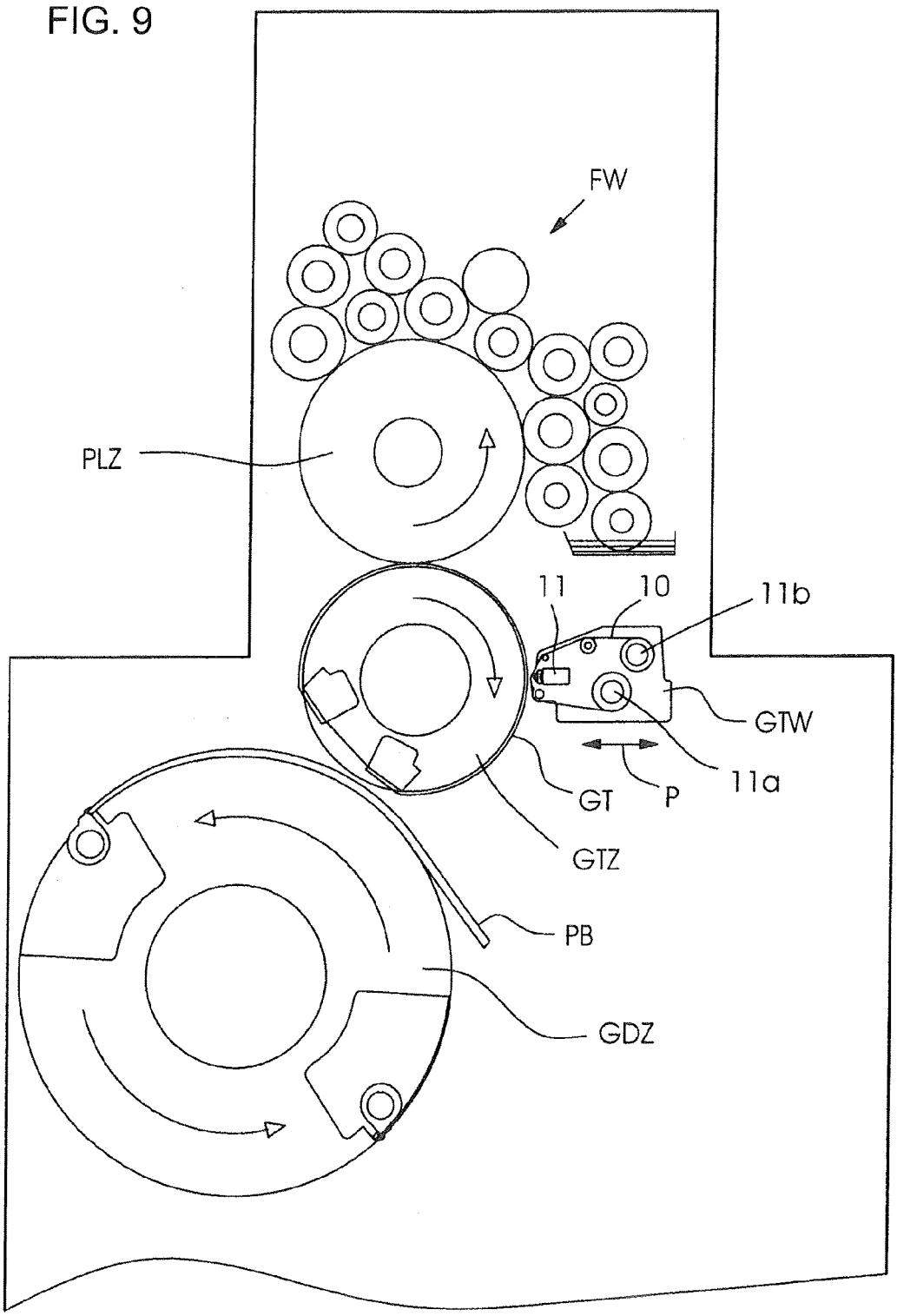
FIG. 9 is a cross-sectional view illustrating cylinders in a printing unit of an offset printing press.

Referring now to the figures of the drawings in detail and first, particularly, to FIG. 9 thereof, there is seen a diagrammatic illustration of cylinders in a printing unit of an offset printing press in a plane perpendicular to axes of the cylinders. Reference symbol PLZ designates a so-called plate cylinder, on which a printing plate inked by rolls of an inking unit FW is fixed through mountings in a clamping channel. During rotation of the cylinders, a printing image on the printing plate is transferred to a blanket GT, which is clamped on a blanket cylinder GTZ illustrated therebelow. Reference symbol PB designates a paper sheet, which is led through between the blanket cylinder GTZ and an impression cylinder GDZ and, in the process, is printed with ink by the blanket GT.

In order to wash the blanket, as is customary in offset printing presses, a blanket washing device GTW is provided, which, during a job change, can be set onto the blanket cylinder GTZ along the direction of an arrow P after the end of a printing operation. This washing device GTW normally contains a washing cloth 10 which, under cyclic clock control, is unwound from a first storage coil 11*a* and wound up on a second take-up coil 11*b* having a drive. In between, the washing cloth 10 is pressed by a pressing element 11 against the surface of the blanket GT to be cleaned.

Such blanket washing devices normally operate in such a way that the cylinder surface to be cleaned is rotated past under the washing cloth which is pressed thereon and the latter is cycled onward repeatedly step by step during one revolution in order to convey the inked strip-like region of the washing cloth repeatedly onward in the direction of the take-up coil 11*b*. The washing device further contains a drive for the movement of the washing cloth and a device for the supply of washing liquid, if the storage or supply roll 11*a* is not already impregnated with washing liquid.

Figure 1:
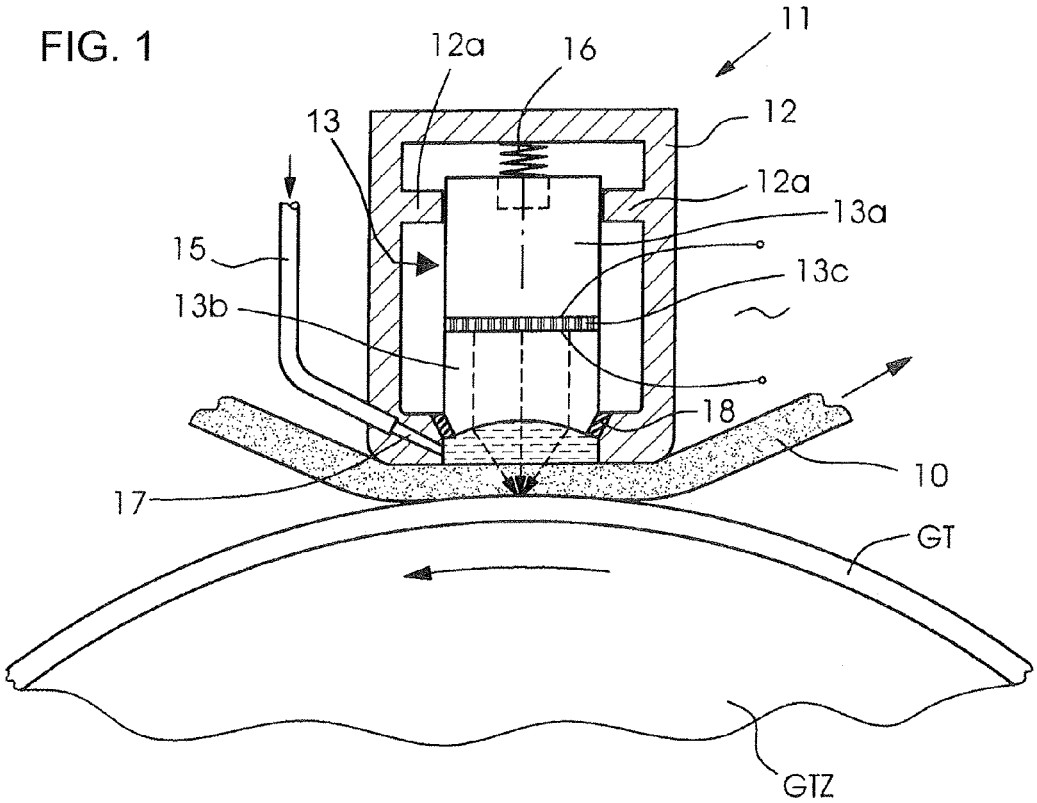
FIG. 1 is a diagrammatic, cross-sectional view of a first exemplary embodiment of a modified pressing element of a blanket washing device according to the invention, for pressing a washing cloth against a blanket on a blanket cylinder.

FIG. 1 shows, in more detail, in a section perpendicular to the cylinder axes, a first exemplary embodiment of a modified pressing element 11 according to the invention, which is part of the blanket washing device GTW.

Figure 1A:
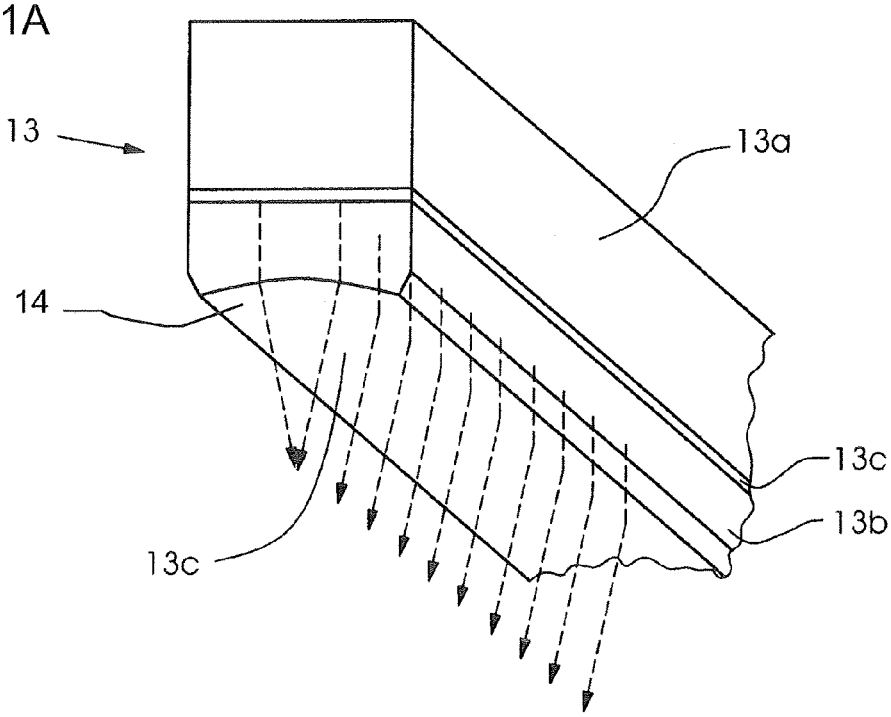
FIG. 1A is a fragmentary, perspective view of a sonotrode for facing the washing cloth.

In the exemplary embodiment according to FIG. 1, the pressing element 11 includes a U-shaped aluminum profiled part 12 which is provided with a longitudinal slot on a side with which it presses the washing cloth 10 against the blanket GT. Located in the interior of the profiled part 12 is an elongated sonotrode 13 having a structure illustrated in FIG. 1A. The sonotrode 13 includes two strip-like masses 13*a* and 13*b*, between which there is disposed a piezo-ceramic layer 13*c*, which has metal electrodes vapor-deposited on both sides. The lower mass or part 13*b* of the sonotrode 13, facing the washing cloth 10, is shaped concavely on its underside 14 and focuses the ultrasonic power emitted onto a narrow, substantially linear focus region on the surface of the blanket GT. The sonotrode 13 is pressed by springs 16 against a seat provided with a seal 18 on inner sides of two limbs of the U-shaped profiled part 12. Strips 12*a* in the profiled part 12 are used for positional fixing in the upper region of the part 13*a* of the sonotrode 13.

As is illustrated in FIG. 1, the two rounded U-shaped limbs of the profiled part 12 press the washing cloth 10 against the surface of the blanket GT. In order to wet the washing cloth with washing liquid, small feed pipes 15 are provided along the profiled part 12 and open into channels 17, through which the washing liquid travels into a space between the washing cloth 10 and the concave surface 14 of the sonotrodes 13 and fills that space. Through the use of the washing liquid, ultrasonic energy is led effectively to the surface of the blanket GT while avoiding excessive reflections and there it is able to loosen dirt and ink residues adhering to the blanket surface, due to establishing cavitation of gas bubbles that are produced in the liquid in a focus region.

Of course, it is also possible to place a plurality of individual shorter sonotrodes in the profiled part 12 instead of a single sonotrode 13. The sonotrodes are then expediently driven with the same phase during the operation of the washing device, in order to avoid destructive interferences. In this case, it can also be expedient to provide webs between the two limbs of the U-shaped profiled part 12, which permit sealing between the individual sonotrodes against the penetration of washing water into the interior of the housing or part 12. In this case, the individual sonotrodes will expediently be inserted through closable openings on the top of the profiled part 12.

Figure 2:
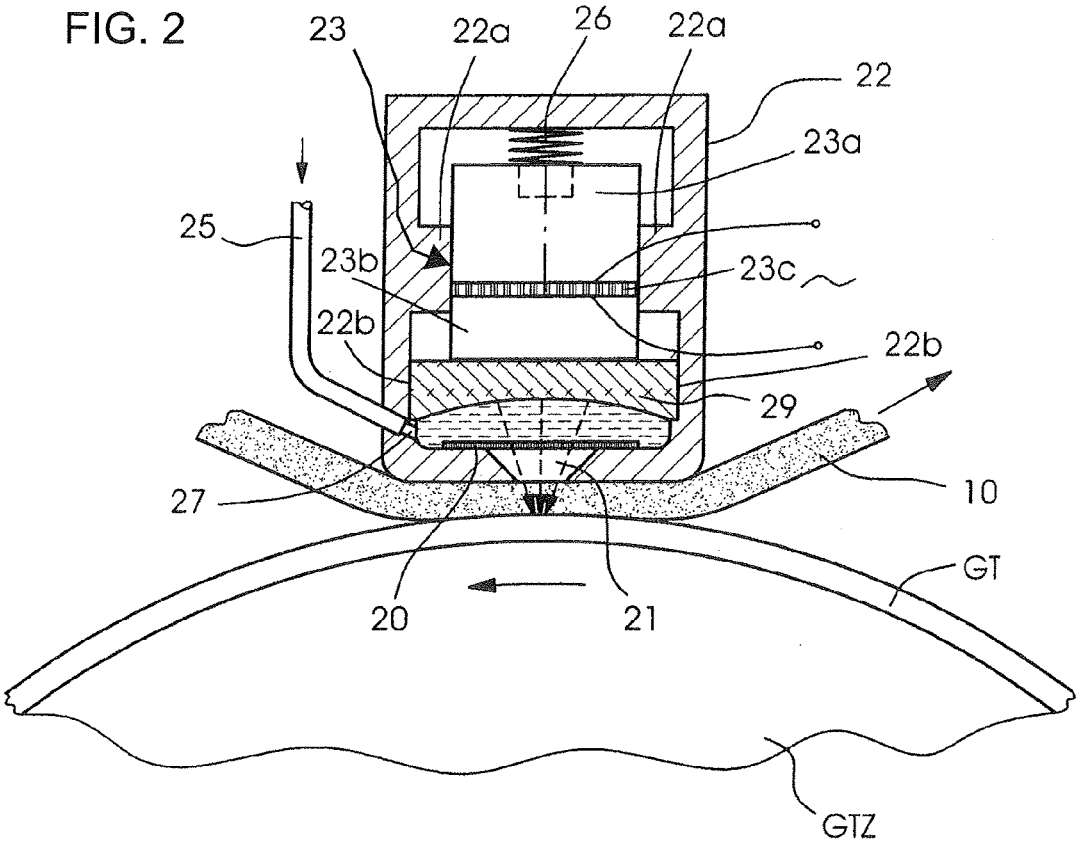
FIG. 2 is a cross-sectional view of a second embodiment of a modified pressing element.

FIG. 2 shows an alternative, second exemplary embodiment of the modified pressing element 11 according to the invention, which is part of the blanket washing device GTW.

In the exemplary embodiment according to FIG. 2, identical or similar parts are provided with a designation that is higher by 10, as compared with FIG. 1, for ease of understanding.

Figure 2A:
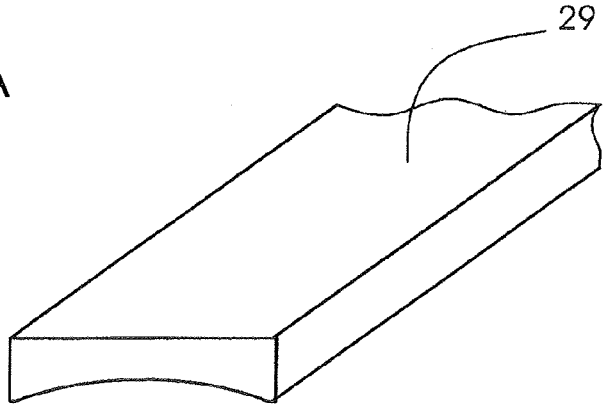
FIG. 2A is a fragmentary, perspective view of a concave cylindrical lens.

In contrast to the exemplary embodiment according to FIG. 1, a plurality of individual sonotrodes 23 are disposed one after another in the hollow U-shaped aluminum profiled part 22 which serves as a pressing element. For example, twenty pieces may be provided having a length of about 5 cm for the blanket cylinder of a printing press in the 105 cm format. These sonotrodes are pressed by springs 26 against the rear side of a concave cylindrical lens 29 made of plastic, which is pushed into the aluminum profiled part 22 over the length of the latter along grooves 22*b*. The concave cylindrical lens 29 is also shown in FIG. 2A. The sonotrodes 23 are secured against lateral displacement by strips 22*a* in the interior of the profiled part 22.

A diaphragm 20 made of plastic, rubber or a porous ceramic, which limits the flow of liquid, is located over an opening 21 matched to an ultrasonic beam lobe between the two U-shaped limbs of the profiled part 22. When choosing the material, the density of the diaphragm is expediently matched to the density of the washing liquid, in order to avoid undesired reflections of the ultrasonic energy at the interface with the diaphragm 20. The diaphragm 20 limits the flow of the washing liquid from the small feed pipes 25 into the washing cloth 10 and ensures that no washing liquid emerges when the washing process has been completed and the pressure in the small feed pipes 25 is switched off.

The cylindrical plastic lens 29 is formed of PLEXIGLASS®, which is polymethyl methacrylate. Since the speed of sound in this material is virtually twice as high as in water, the planoconcave cylindrical lens acts as a converging lens and concentrates the ultrasonic power in a very narrow linear region, as is indicated by arrows.

Of course, given appropriate dimensioning of the radius of the cylindrical lens and its distance from the surface of the blanket, it is also possible to use other plastics such as polyacrylate, etc.

The use of a plurality of individual sonotrodes results in the advantage that the length of the pressing element of the blanket washing device can be matched to different format widths without specific individual sonotrodes having to be fabricated for the format in each case. In the same way, instead of the cylindrical lens made of plastic, a number of individual toroidal or cylindrical individual lenses can be provided, each being assigned to the individual sonotrodes. In this case, a toroidal form of the individual lenses assists the uniformity of the propagation of sound along the cylinder surface beyond regions switched off by webs.

Figure 3:
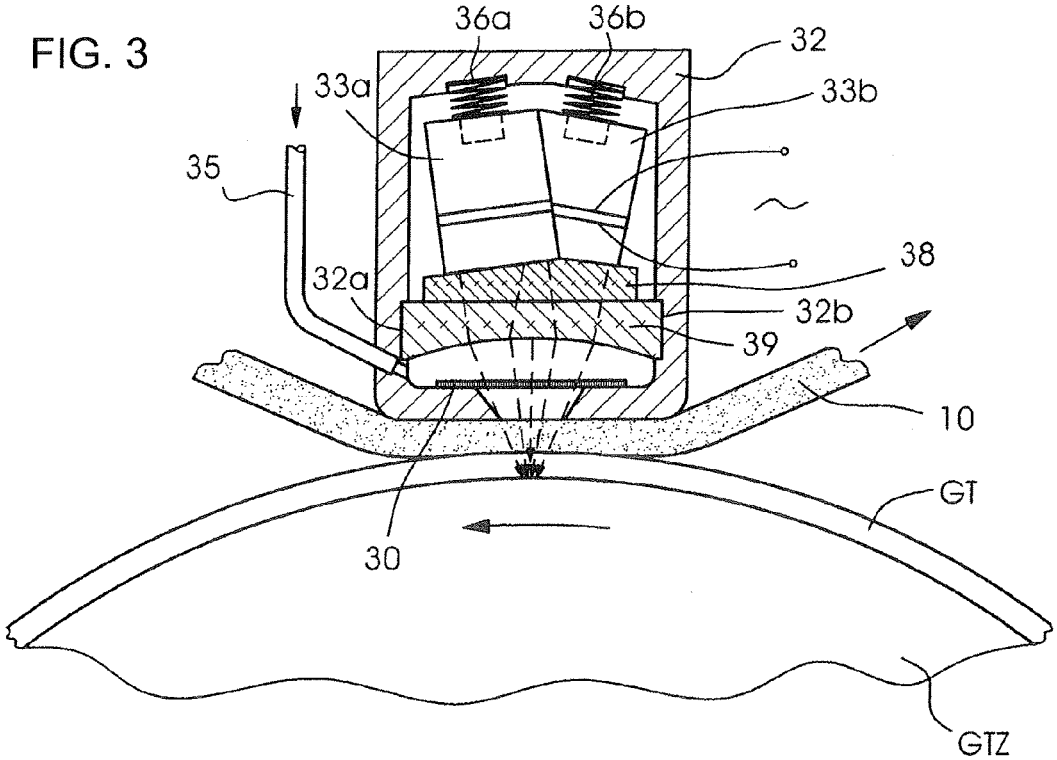
FIG. 3 is a cross-sectional view of a third embodiment of a modified pressing element.

FIG. 3 shows a third exemplary embodiment of the modified pressing element 11 according to the invention, which is part of the blanket washing device GTW.

Figure 3A:
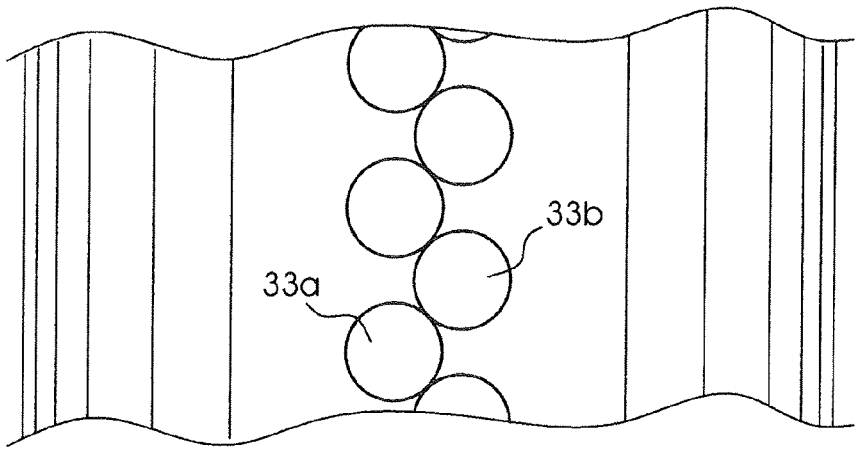
FIG. 3A is a plan view of ultrasonic generators packed closely together and offset.

In the exemplary embodiment according to FIG. 3, the cubical sonotrodes are replaced by ultrasonic generators 33*a*, 33*b* . . . with a circular cross section. Such ultrasonic generators can be procured inexpensively as bought in parts, since they are used in high numbers in other applications. In the present case, the ultrasonic generators 33*a*, 33*b* . . . are not disposed one after another in a line but packed closely against one another with an offset and in each case inclined alternately with respect to one another, as is illustrated in FIG. 3A. Springs 36*a*, 36*b* . . . respectively assigned to the ultrasonic generators press the ultrasonic generators 33*a*, 33*b* . . . onto a prismatic strip 38, which is adhesively bonded to the rear of a cylindrical lens 39. The prismatic strip 38 is composed of the same material as the cylindrical lens 39, so that impedance steps, such as otherwise occur at the transition into another medium, are avoided.

Figure 4:
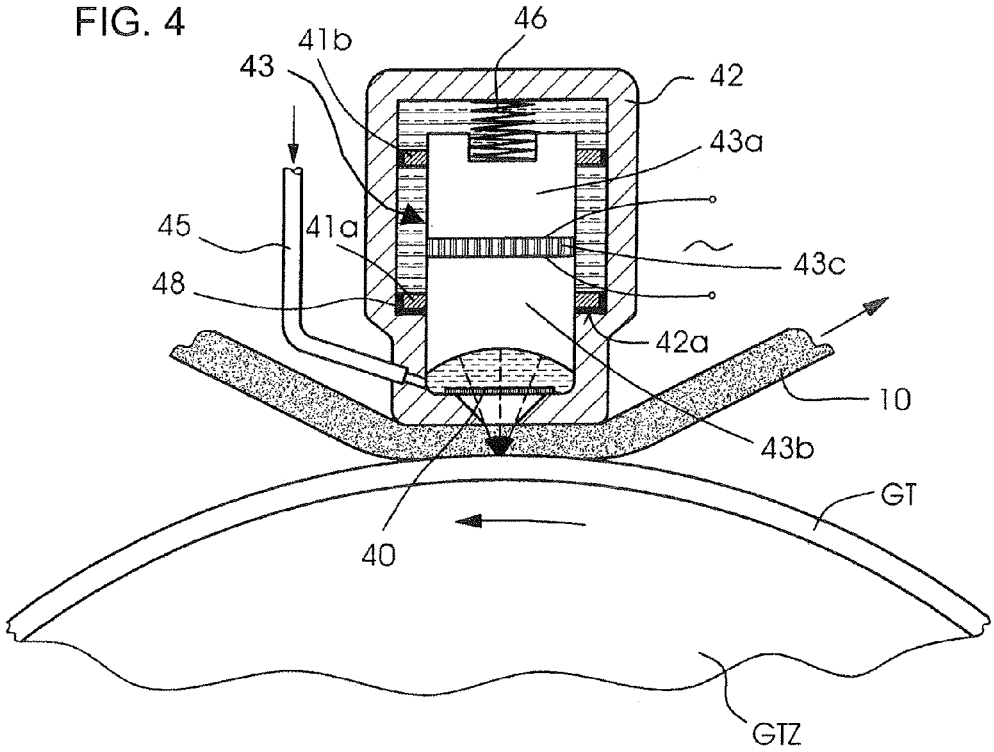
FIG. 4 is a cross-sectional view of a fourth embodiment of a modified pressing element.

FIG. 4 shows a fourth exemplary embodiment of the modified pressing element 11 according to the invention, which is part of the blanket washing device GTW.

Figure 4A:
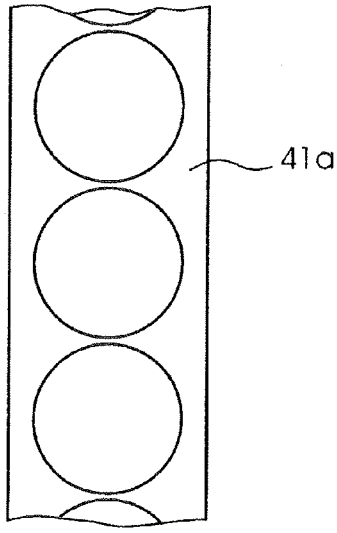
FIG. 4A is a fragmentary, plan view of a slide having recesses for receiving the ultrasonic generators.
Figure 4B:
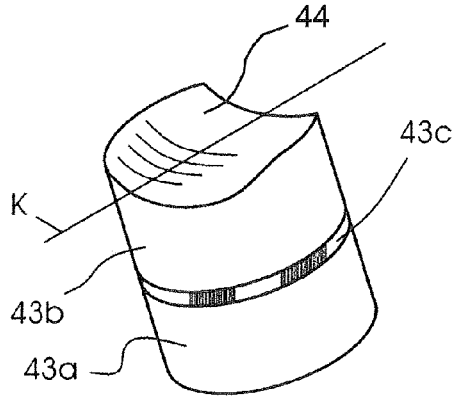
FIG. 4B is a perspective view of an ultrasonic generator.

In the exemplary embodiment according to FIG. 4, simple, inexpensive, cylindrical ultrasonic generators 43 are likewise used, but they are inserted one after another with their axes parallel to one another into circular recesses in lower and upper slides 41*a*, 41*b*, as shown in FIG. 4A. The array of cylindrical ultrasonic generators formed in this way is inserted at the end into an aluminum profiled part 42 illustrated in FIG. 4. The lower slide 41*a*, facing the blanket GT, rests on a shoulder 42*a* in the interior of the profiled part 42 over a sealing strip 48. The interior of the profiled part 42 above the part 41*a* is filled with oil, which is used to dissipate the heat produced in the ultrasonic generators 43. A lower side 44 of the ultrasonic generators 43, facing the washing cloth 10, is shaped cylindrically concavely, as shown in FIG. 4B. Axes K of the cylindrically concave recesses of all of the ultrasonic generators 43 accommodated behind one another in the slides 41*a*, 41*b* are aligned in a line parallel to the axis of the blanket cylinder GTZ. In this way, the ultrasonic energy emitted by the ultrasonic generators 43, as illustrated by arrows in FIG. 4, is focused substantially onto a narrow linear region parallel to the cylinder axis on the surface of the blanket GT, given a suitable choice of the radius of curvature of the concavely cylindrical recess 44 in the ultrasonic generators 43 and the spacing of the ultrasonic generators from the washing cloth.

Figure 5:
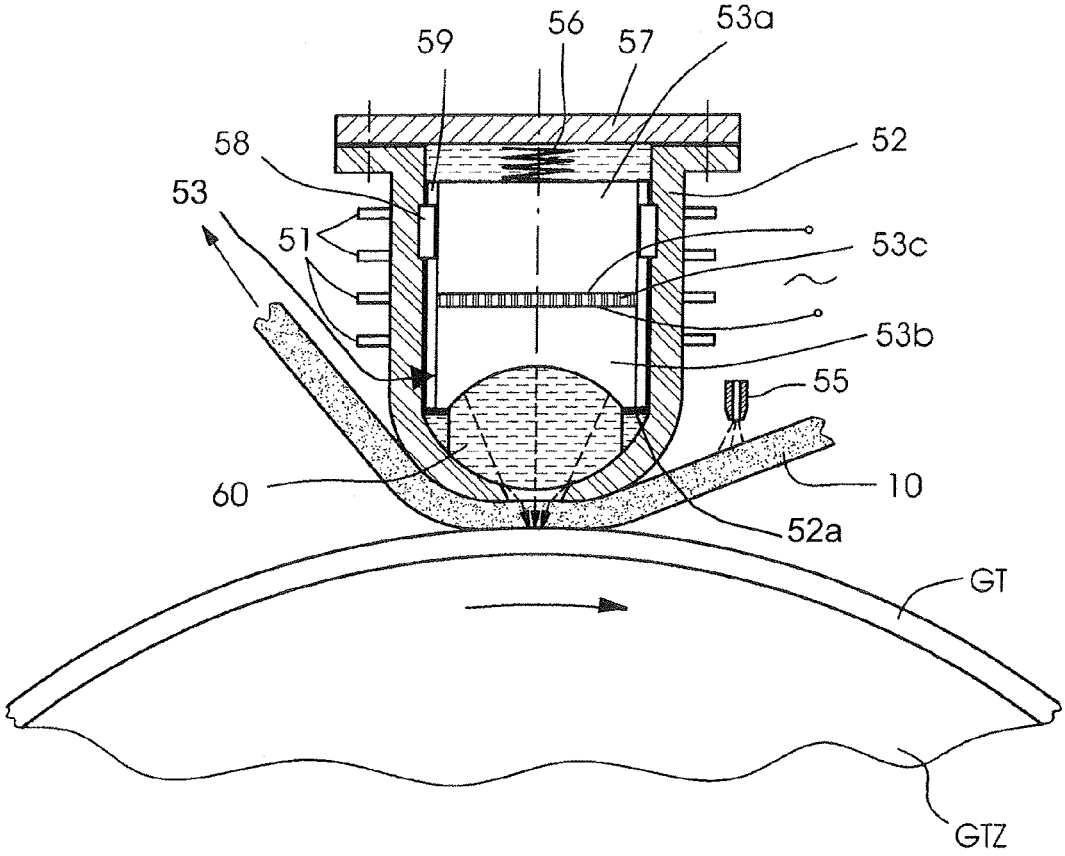
FIG. 5 is a cross-sectional view of a fifth embodiment of a modified pressing element.

FIG. 5 shows a fifth exemplary embodiment of the modified pressing element 11 according to the invention, which is part of the blanket washing device GTW.

In the exemplary embodiment according to FIG. 5, as opposed to that according to FIG. 4, the aluminum profiled part 42 has been replaced by a plastic profiled part 52. The profiled part 52 has a U-shaped cross section and, on its side facing the washing cloth 10, is closed like a trough, while its two limbs having a U-shaped cross section on the opposite side are closed at the top by a cover 57. On the outside, for the purpose of reinforcement and to dissipate heat, the plastic profiled part 52 bears a plurality of ribs 51 extending over its entire length. The outer circular cross section of the profiled part 52 on the side toward the washing cloth is flattened and matched to the radius of the blanket GT. In this way, in the region in which it rests on the washing cloth 10, the wall of the profiled part 52 is already given the shape of a concave cylindrical lens, which once more focuses the ultrasonic energy emitted from the underside of the ultrasonic generators 53 inserted into the profiled part before the energy strikes the blanket, and focuses it in a linear region of a blanket surface.

The ultrasonic generators 53 are the same as those according to FIG. 4 but are placed from above in the plastic profiled part 52 with the cover 57 removed, on strips 52*a* in the profiled part 52. Pins 58 in conjunction with a longitudinal groove 59 in the ultrasonic generators act as an anti-rotation safeguard and hold the generators 53 in their place. The interior of the profiled part 52 is filled with a nonconductive liquid which has a considerably lower density than the material of the plastic profiled part 52. In this way, a biconvex liquid rod 60 between the concave undersides of the ultrasonic generators and the concave inner side of the profiled part 52 acts as a cylindrical converging lens, by which the ultrasonic power is focused on a linear region. The nonconductive liquid additionally serves to absorb the heat loss produced during the operation of the ultrasonic generators 53, in order to ensure that the generators 53 do not heat up excessively.

In this exemplary embodiment, the washing liquid is sprayed onto the washing cloth 10 by separate spray nozzles 55 beside the pressing element. The washing cloth 10 is moved at a slow speed past the pressing element during the washing, while at the same time the cylinder GTZ having the blanket GT moves the blanket GT under the pressing element and the washing cloth 10 in the opposite direction.

Figure 6:
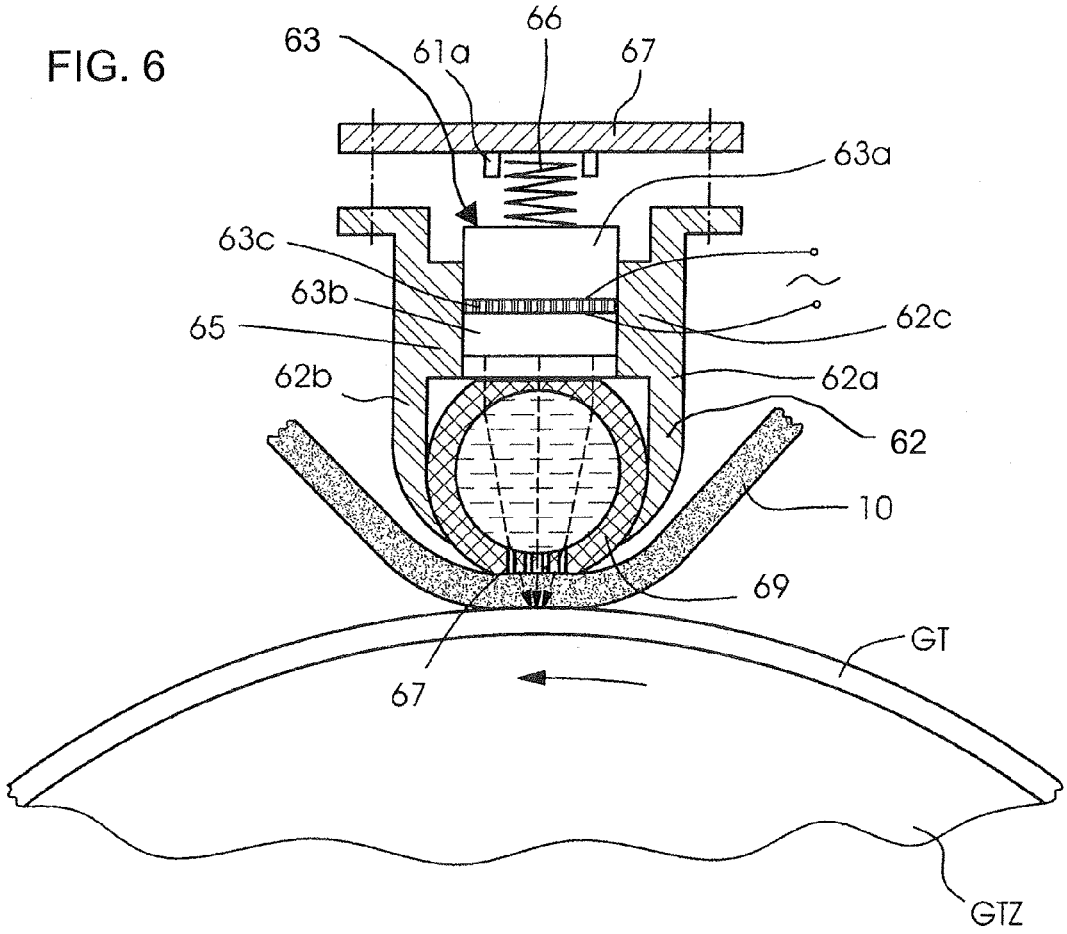
FIG. 6 is a cross-sectional view of a sixth embodiment of a modified pressing element.
Figure 6A:
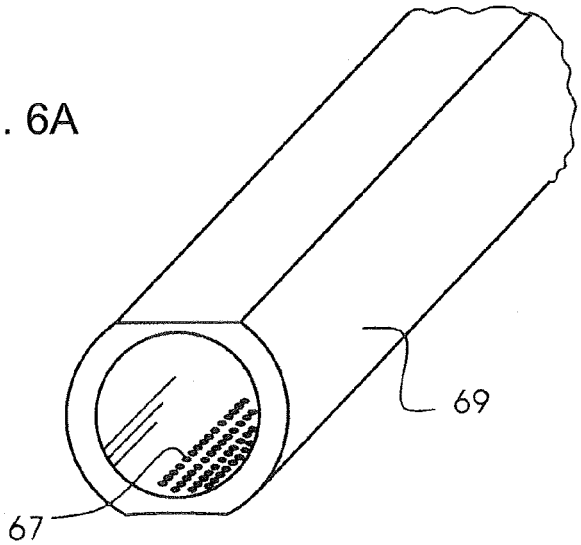
FIG. 6A is a fragmentary, perspective view of a tube for supporting an ultrasonic generator.

FIG. 6 shows a sixth exemplary embodiment of the modified pressing element 11 in accordance with the invention, which is part of the blanket washing device GTW.

In the exemplary embodiment according to FIG. 6, the housing of the pressing element includes a stable metal housing with an H-shaped cross section which is open at the top and bottom. Holes are provided close together in a cross strut 62*c* of a profiled part 62 connecting two limbs 62*a* and 62*b*, to accommodate cylindrical ultrasonic generators 63, which are plugged into the holes.

A lower region of the limbs 62*a* and 62*b* tapers somewhat toward the center. A plastic tube 69, which is inserted into this region, is made of a material having a very much higher density than the washing liquid, such as polyethylene. This plastic tube is flattened at the top and bottom on both sides. Flat undersides of the ultrasonic generators 63 are placed on the upper flattened portion, while the plastic tube 69 is placed with its lower flattened portion on the washing cloth 10 and is pressed onto the latter by springs 66 acting through the ultrasonic generators 63 when the washing device with the profiled part 62 is fed in the direction of the blanket GT.

Capillaries 67, through which the washing liquid emerges under appropriate pressure and wets the washing cloth 10, are introduced into the tube in the region of the lower flattened portion.

In this exemplary embodiment, the cylindrical liquid rod of the washing liquid, in conjunction with the planoconcave cylindrical lenses of the flattened portions of the plastic tube 69, focuses the ultrasonic energy in the desired way onto a narrow linear region. In addition, in this exemplary embodiment, the springs 66 perform a dual function: they press the ultrasonic generators 63 firmly onto their seat and they press the tube part 69 of the pressing element firmly against the washing cloth 10.

Figure 7:
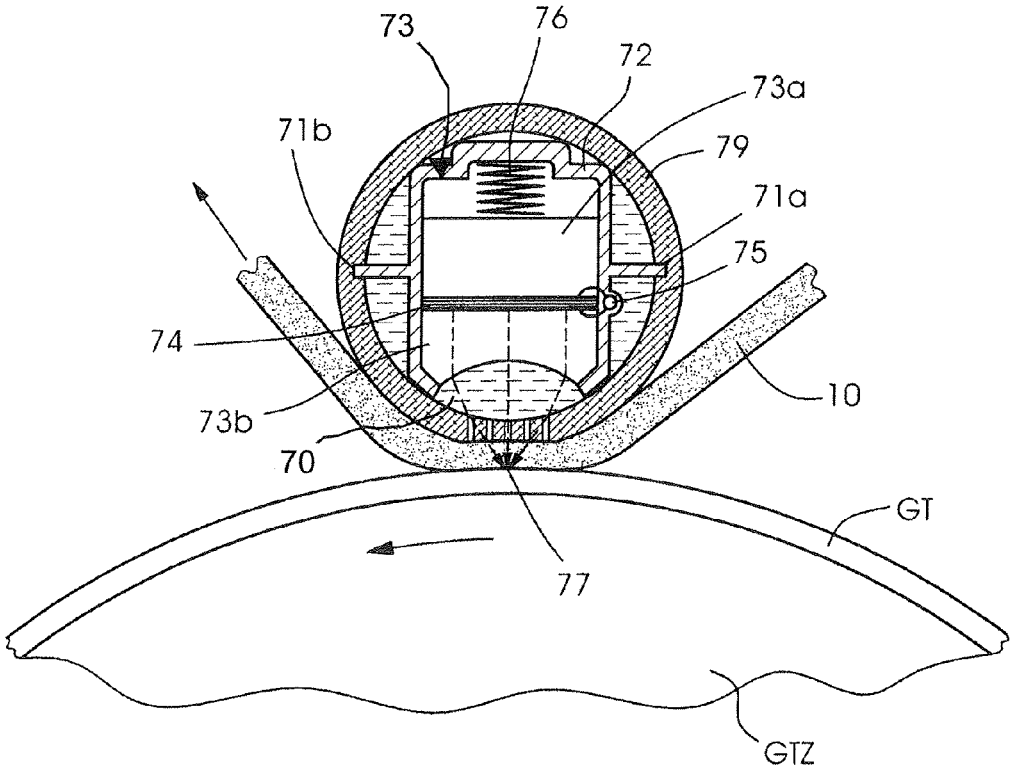
FIG. 7 is a cross-sectional view of a seventh embodiment of a modified pressing element.
Figure 8:
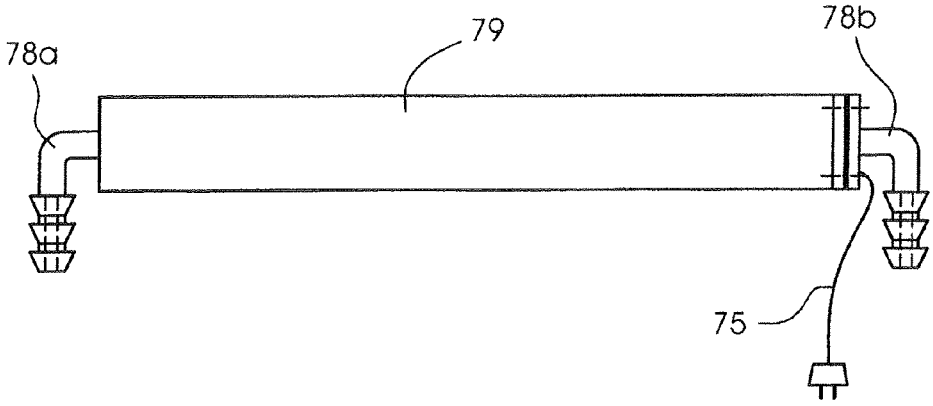
FIG. 8 is an elevational view of a tube to be connected to a cooling unit.

FIG. 7 shows a seventh exemplary embodiment of the modified pressing element 11 in accordance with the invention, which is part of the blanket washing device GTW.

In the exemplary embodiment according to FIG. 7, the pressing element for the washing cloth 10 is composed overall of a thick-walled plastic tube 79, that is closed on both sides and, as is seen from the view according to FIG. 7, is provided on respective sides with an inlet connecting piece 78*a* and an outlet connecting piece 78*b* for the washing liquid. The tube 79 is connected to a cooling unit, through which the heat loss arising during the washing operation is dissipated through the ultrasonic generators. The plastic tube 79 is composed of the same material as the tube 69 of FIG. 6 and likewise bears a flattened portion on its underside, which is provided with capillaries 77 for the passage of the washing liquid.

A metal profiled part 72 is pushed into the plastic tube 79 and is held there by two projections 71*a* and 71*b* in corresponding grooves in the plastic tube 79. A plurality of ultrasonic generators 73 having a rectangular cross section in encapsulated form are accommodated close together in the metal profile 72, with their undersides being cylindrically concavely shaped as in the exemplary embodiment according to FIG. 1. Due to this concave shape, a wedge of the washing liquid 70 between the undersides of the ultrasonic generators 73 and the concave inner side of the tube 79 becomes a "thick cylindrical lens" and focuses the ultrasonic waves on a linear region. In this exemplary embodiment, the washing liquid 70 also serves simultaneously to cool the ultrasonic generators.

The invention claimed is

1. A washing device for a cylinder in a printing press, the washing device comprising:

a washing cloth for removing at least contaminants and ink from a surface of the cylinder;

an ultrasonic source directing sound energy onto the surface of the cylinder for assisting a washing operation, said ultrasonic source including a configuration of a plurality of individual oscillators disposed parallel to an axis of the cylinder; and a focusing device disposed in front of said ultrasonic source for concentrating the sound energy onto a substantially linear focus region on the surface of the cylinder extending parallel to the axis of the cylinder.

2. The washing device according to claim 1, wherein said individual oscillators are disposed along a straight line parallel to the cylinder axis.

3. The washing device according to claim 1, wherein said individual oscillators are disposed alternately offset relative to a straight line parallel to the axis of the cylinder.

4. The washing device according to claim 1, wherein said focusing device has an ultrasonic cylindrical lens.

5. The washing device according to claim 1, wherein said focusing device includes a plurality of toroidal or cylindrical sound lenses.

6. The washing device according to claim 1, wherein said focusing device is at least partly formed by a cylindrically concave shape of said oscillators.

7. The washing device according to claim 1, which further comprises a liquid disposed in a region between said ultrasonic source and the surface of the cylinder.

8. The washing device according to claim 7, wherein said liquid is a constituent part of said focusing device.

9. The washing device according to claim 7, wherein said liquid is located in a region between said focusing device and the surface of the cylinder.

10. The washing device according to claim 7, wherein said liquid is a washing liquid.

11. The washing device according to claim 10, wherein said washing liquid is supplied to a region between said focusing device and said washing cloth.

12. The washing device according to claim 11, which further comprises a diaphragm permeable to ultrasound, said diaphragm being disposed between said washing cloth resting on the surface of the cylinder and said region between said focusing device and said washing cloth being filled with said washing liquid, and said diaphragm limiting a flow of liquid.

13. The washing device according to claim 12, wherein said diaphragm is formed as a perforated rubber or plastic part or a porous ceramic part.

14. The washing device according to claim 12, wherein said diaphragm acts as a cylindrical lens.

15. The washing device according to claim 14, wherein said cylindrical lens presses said washing cloth against the surface of the cylinder.

16. The washing device according to claim 1, which further comprises a drive moving said washing cloth continuously during the washing operation.

17. The washing device according to claim 1, wherein said washing cloth has fibers formed of a material slightly absorbing or attenuating ultrasonic waves.

18. The washing device according to claim 1, wherein said ultrasonic source has an axial extent of at least 70 cm.

19. The washing device according to claim 1, wherein said ultrasonic source has an axial extent of 90 to 110 cm.

20. The washing device according to claim 1, wherein said ultrasonic source has a power consumption of less than 1000 Watts during the washing operation.

21. The washing device according to claim 1, wherein said washing cloth has a thickness of at least 1 mm in an unpressed state.

22. The washing device according to claim 1, which further comprises an electrically nonconductive liquid filling a space between said ultrasonic source and said focusing device.

23. The washing device according to claim 1, which further comprises oil surrounding said ultrasonic source and absorbing and dissipating heat produced during operation of said ultrasonic source.

24. A washing device for a cylinder in a printing press, the washing device comprising:

a washing cloth for removing at least contaminants and ink from a surface of the cylinder;

an ultrasonic source directing sound energy onto the surface of the cylinder for assisting a washing operation; and a focusing device disposed in front of said ultrasonic source for concentrating the sound energy onto a substantially linear focus region on the surface of the cylinder extending parallel to an axis of the cylinder, said focusing device formed as a hollow tubular or rod-shaped part having an interior filled with washing liquid.

25. The washing device according to claim 24, wherein said tubular or rod-shaped part has holes or capillaries for an emergence of washing liquid.

26. The washing device according to claim 1, wherein said cylindrical lens is formed of a plastic in which the speed of sound is higher than in water.

27. The washing device according to claim 24, wherein said rod-shaped or tubular part is formed of a plastic in which the speed of sound is higher than in water.

28. The washing device according to claim 26, wherein said plastic is formed of a material selected from the group consisting of polystyrene, polymethyl methacrylate, polyethylene and polyacrylate.

29. The washing device according to claim 27, wherein said plastic is formed of a material selected from the group consisting of polystyrene, polymethyl methacrylate, polyethylene and polyacrylate.

30. The washing device according to claim 1, which further comprises common drive electronics driving said individual oscillators with the same frequency and a fixed phase relationship to one another.

* * * * *